United States Patent [19]

Nelson et al.

[11] 4,444,656

[45] Apr. 24, 1984

[54] CLASSIFYING APPARATUS AND METHODS

[75] Inventors: Ronald W. Nelson; Robert D. Nelson, both of Princeton, Ill.

[73] Assignee: Production Engineered Products, Inc., Walnut, Ill.

[21] Appl. No.: 345,213

[22] Filed: Feb. 3, 1982

[51] Int. Cl.[3] ..... B07B 1/34

[52] U.S. Cl. ..... 209/347; 55/300

[58] Field of Search ..... 209/241, 309, 310, 330, 209/334, 346, 347, 357, 365 R, 381, 382, 405, 408, 420, 421; 55/300; 210/388, 384

[56] References Cited

U.S. PATENT DOCUMENTS

| | | | |
|---|---|---|---|
| 2,077,678 | 4/1937 | Delamater | 209/346 |
| 2,311,814 | 2/1943 | Behnke et al. | 209/382 |
| 2,345,947 | 4/1944 | Parks | 209/408 |
| 3,468,418 | 9/1969 | Renner | 209/346 |
| 3,666,095 | 5/1972 | Krynock et al. | 209/405 |
| 3,796,311 | 3/1974 | Krause | 209/382 |
| 3,954,604 | 5/1976 | Krause et al. | 209/365 |
| 4,137,157 | 1/1979 | Deister et al. | 209/405 |
| 4,319,993 | 3/1982 | Krause | 209/365.5 |

FOREIGN PATENT DOCUMENTS

| | | | |
|---|---|---|---|
| 2417111 | 10/1975 | Fed. Rep. of Germany | 209/405 |
| 2701341 | 7/1978 | Fed. Rep. of Germany | 209/382 |

*Primary Examiner*—Bernard Nozick

*Attorney, Agent, or Firm*—Lockwood, Dewey, Alex & Cummings

[57] ABSTRACT

Classifying apparatus and methods for the separation of solids of differing sizes includes a screening deck having an inclined frame and a screen in the frame on which the solids are deposited and moved downwardly. A plurality of beams extend beneath the screen transversely of the frame and the ends of the beam are mounted to the frame by a resilient mounting to isolate vibrations of the beam from the frame. A tappet assembly is fixed to each of the beams and contacts the underside of the screen and a vibrator motor is mounted to each of the beams to directly vibrate the beam, the tappet assembly of each beam, and the screen. Controls may be provided for independently operating each of the vibrators to vary one or both of the frequency or the amplitude of the vibrations of the screen over its length. The screen preferably includes a plurality of screen portions which are crowned transversely of the frame by the tappet assemblies, and the tappet assemblies include a pair of spaced parallel bars of continuous length extending transversely of the frame and in contact with the screen.

20 Claims, 7 Drawing Figures

CLASSIFYING APPARATUS AND METHODS

BACKGROUND AND SUMMARY OF THE INVENTION

The present invention relates to classifying apparatus and methods and, more particularly, to a vibrating screening deck and method of classifying solid particulates.

Vibrating screening decks have been widely used in the past in the classification and separation of particulate solids of varying particle sizes and composition, such as limestone, coal and other ores. Such screening decks have typically comprised a generally rectangular frame which is suspended in operation and which has a screen cloth in the frame upon which the materials to be classified are deposited. The frame and screen in such decks are suspended at an angle and the entire frame with its screen is vibrated to cause the solid particulates to move down the screen. As the materials move down the vibrating screen, solids of smaller mesh size pass through the screen as "unders" and solids of larger dimensions are discharged from the lower end of the screen as "overs".

One of the disadvantages of these prior screening decks and methods is the substantial energy which must be consumed in vibrating the entire deck including its frame. Such decks typically employ a vibrator motor of upwards of 40 horsepower or more. Another disadvantage of such prior decks is that they are susceptible to the need for frequent maintenance in view of the substantial energy which is imparted to the deck over long periods of time. Still another disadvantage of these prior decks is that they are susceptible to blinding of their screens due to the accumulation in the screen mesh of the solids fines.

At least one screening deck has been developed in the past in which an attempt has been made to reduce the substantial energy requirements. In such deck, a plurality of somewhat smaller vibrator motors have been employed which are coupled to a tappet shaft which extends beneath the screen at various locations spaced along the length of the screen. The tappet shaft is coupled by relatively complex linkages to the vibrator motor on the exterior of the frame of the deck and a plurality of tappet arms are positioned on the shaft which move eccentrically to tap the screen from beneath. In such prior screening deck, only the screen is vibrated, rather than the entire frame and, thus, the energy consumption is reduced. However, the particular tappet arrangement in such screening deck necessitates relatively complex linkages and causes localized tapping of the screen both of which result in early wear of the mechanisms and the screen. Moreover, such prior screening deck necessitates fairly frequent adjustment as the screen becomes stretched during use and relies upon the weight of the material on the screen to keep the screen in contact with the tappets. Moreover, such prior screening deck is still subject to substantially the same screen blinding problems as the prior art screening decks previously described.

The classifying apparatus and method of the present invention overcomes many, if not all, of these problems encountered by the prior art. In a classifying apparatus and method incorporating the principles of the present invention, a substantial reduction in power consumption is realized and the apparatus weight is substantially reduced along with the frequency of maintenance. In a classifying apparatus and method incorporating the principles of the present invention, the vibration of each section of the screen may be tailored or fine tuned over the length of the screen in either one or both of frequency and amplitude of the vibration to substantially reduce screen blinding and to realize a substantial improvement in the quality of separation and efficiency of the classification operation. In a classifying apparatus incorporating the principles of the present invention, only the screen is vibrated and this vibration is isolated from the frame and the vibration is directly induced to the screen, eliminating the need for elaborate tappet mechanisms and linkages and resulting in the realization of the aforementioned advantages. In a classifying apparatus and method incorporating the principles of the present invention, tappet assemblies are self-adjusting to the tension on the screen, thereby resulting in uniform pre-loading conditions of the screen against the tappet assemblies, vibration over the width of the screen is uniform, and the vibration occurs at more locations along the length of the screen. Moreover, the tappet assemblies of the classifying apparatus and method of the present invention enhance crowning of the screen and do not substantially rely upon the weight of the material on the screen to maintain the tappets in contact with the screen, thus, resulting in more uniform performance over wide variations in screen loading and materials handled. In a classifying apparatus and method incorporating the principles of the present invention, one or both of the frequency and amplitude of the screen vibration may be varied and fine tuned along the length of the screen as the load on the screen diminishes, thereby substantially further reducing the energy requirements, blinding, and the carryover of overs toward the discharge end of the screen which should otherwise be unders.

In one principal aspect of the present invention, classifying apparatus comprises frame means having a pair of spaced elongate rigid members and screen means in the frame means between members. Beam means extend beneath the screen means and tappet means are fixed to the beam means and contact the screen means. Vibrator means are mounted on the beam means between the frame members so as to directly vibrate the beam means, tappet means and screen means.

In another principal aspect of the present invention, classifying apparatus includes frame means having a pair of spaced elongate rigid members and screen means in the frame means between the members. A plurality of vibration inducing means are spaced along the length of the screen means for vibrating the screen means and control means independently operate respective ones of the vibration inducing means to vary at least one of the frequency or amplitude of the vibrations of the screen means over its length.

In still another principal aspect of the present invention, a method of classifying solids from each other includes the steps of introducing the solids to be classified to an inclined screen, vibrating the screen, and varying at least one of the frequency and amplitude of the screen vibrations between the location at which the solids are introduced to the screen and the opposite end of the screen.

These and other objects, features and advantages of the present invention will be clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENTS

Figure 1:
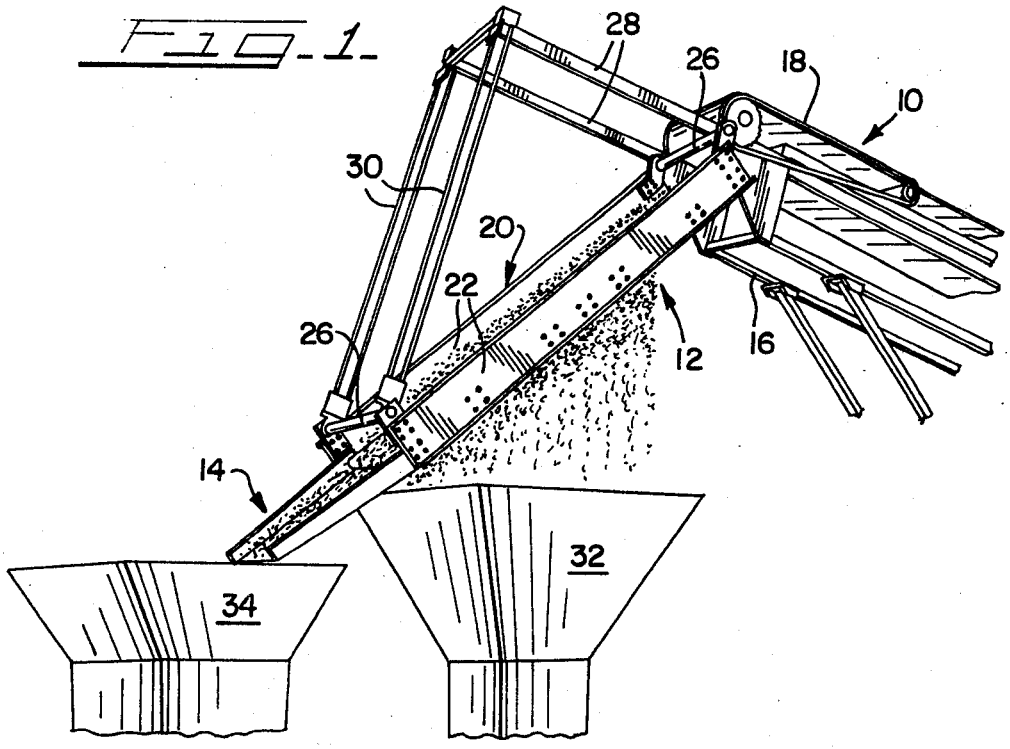
FIG. 1 is an overall perspective view showing a preferred embodiment of the classifying apparatus and methods in operation in accordance with the principles of the present invention.

An overall view of a classifying assembly which incorporates a preferred embodiment of apparatus and method of the present invention is shown in FIG. 1. Generally, the assembly comprises a conveyor unit 10, the vibrating screening deck 12 of the present invention, and a chute 14 for overs.

The conveyor unit 10 is conventional and forms no part of the present invention. Accordingly, the conveyor unit 10 will be described in general terms only, it being understood that the selection of such unit is well within the skill of a person skilled in the art. The conveyor unit, generally 10, comprises a rigid frame structure 16 which supports a suitable moving conveyor, such as an endless conveyor belt 18, for moving the solid materials to be classified to the top of the screening deck 12 where they are discharged onto the deck.

Figures 2, 5, 6, 7:
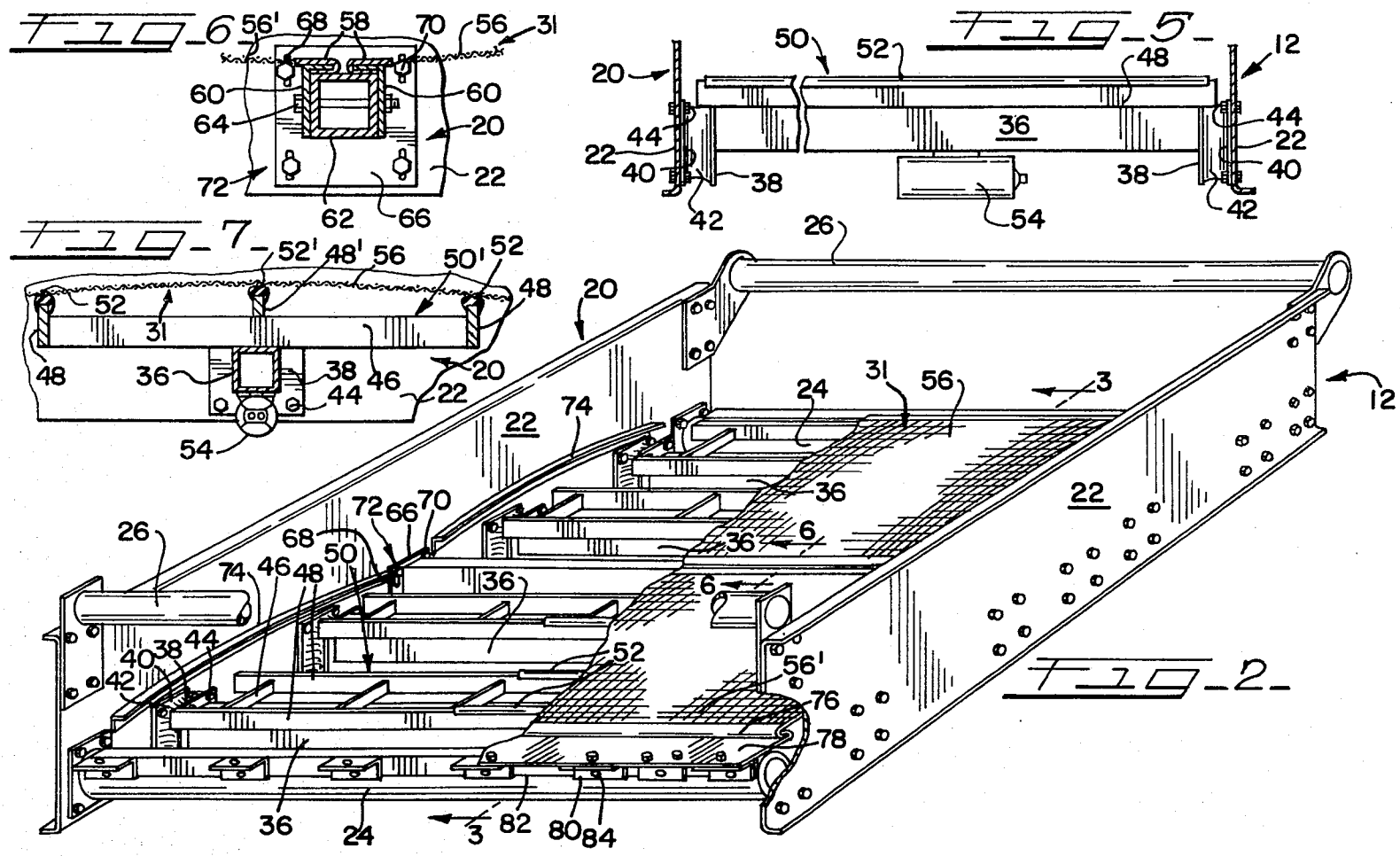
FIG. 2 is an enlarged perspective view of the screening deck shown in FIG. 1 which has been partially broken to show the components of the deck underlying the screen.
FIG. 5 is a cross-sectioned end elevational view of the vibrating and tappet assembly as viewed substantially along line 5—5 of FIG. 4.
FIG. 6 is a cross-sectioned side elevational view of a screen anchor assembly as viewed substantially along line 6—6 of FIG. 2.
FIG. 7 is a cross-sectioned side elevational view of a second preferred embodiment of screen vibrating and tappet assembly in accordance with the principles of the present invention.

The deck 12 comprises a rigid frame, generally 20, having a pair of longitudinally extending, elongate side members 22, such as channel beams as shown particularly in FIG. 2. The elongate frame members 22 are held apart and spaced in generally parallel relationship to each other by transverse members 24 as shown in FIG. 2 to form an essentially box-like structure. In addition, the frame members 22 may also be spaced by pivot mounting tubes 26 as shown in FIG. 2 which provide the additional function of assisting in the suspension of the frame in angular relationship to the conveyor unit 10 as shown in FIG. 1 by way of the cantilevered support arms 28 and adjustable suspension cables 30, also as shown in FIG. 1. The suspension cables 30 may be adjusted to change the angle of inclination of the screening deck 12, depending upon the nature of the particular solids to be classified. Again, the manner of suspending the screening deck 12 of the present invention may take various other forms and does not form a part of the present invention per se.

Also as is conventional in such screening decks, some form of meshed screening material, generally 31, is contained within the frame 20 over which the solids to be classified are passed. As a result, these solids will be separated and classified by the fines passing through the screen mesh as unders as the material moves down the screen 31 where it may either be collected in a pile upon the ground or in a suitable hopper or other container 32 as shown in FIG. 1. Conversely, the larger materials will not pass through the screen mesh, but will continue down the screen and will be discharged from the screen as overs, via chute 14. Likewise, the overs also may be collected as a discrete pile upon the ground or collected in some form of container or the like 34 as shown in FIG. 1.

Figure 3:
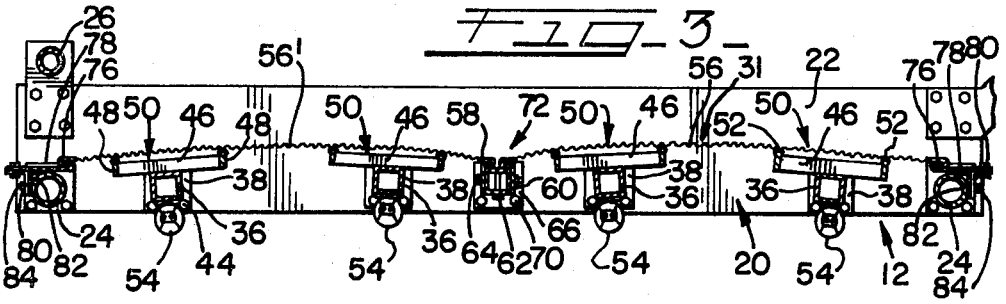
FIG. 3 is a cross-sectioned side elevational view of the screening deck as viewed substantially along line 3—3 of FIG. 2.
Figure 4:
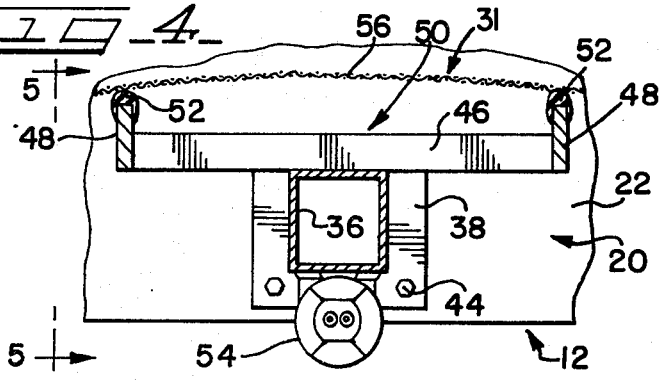
FIG. 4 is an enlarged cross-sectioned side elevational view of one preferred embodiment of one of the vibrating and tappet assemblies shown in FIG. 3.

Turning now to the apparatus and method of the present invention, a plurality of rigid beams 36 are positioned transversely between the side members 22 in spaced relationship to each other along the length of the frame 20. Beams 36 preferably comprise rectangular tubes which may be approximately 4 inches square in cross section. The ends of each beam 36 terminate in a flange plate 38 which is fixed thereto by suitable means, such as welding. A complementary plate 40 is mounted to the elongate side members 22 and a resilient pad 42, formed of rubber or other suitable resilient material, is positioned between plates 38 and 40 to allow the beams 36 at least some measure of limited rocking motion relative to side members 22 as shown in FIG. 3 and also to isolate vibrations which are imparted to the beams 36, as will be explained in further detail to follow, from the side members 22 and the frame 20 generally. Bolts 44 are preferably utilized to mount the flanges 38 and 40 and resilient pad 42 to each other, to the ends of the beams 36 and to the frame side members 22.

A plurality of rigid spacers 46 are mounted to the tops of the beams 36. The spacers 46 extend in a direction generally perpendicular to the axis of the beams 36. A pair of elongate bars 48 extend transversely of the frame 20 and are rigidly attached to the ends of the spacers 46, such as by welding. The spacers 46 space the bars 48 in generally parallel relationship to each other. The spacers 46 and bars 48, thereby, define a tappet assembly, generally 50, which directly continuously contacts and supports the underside of the screen 31 to directly induce vibrations in the screen as will be described in further detail to follow. The tops of the bars 48 preferably include a suitable resilient covering, such as a rubber bead 52, which contacts the underside of the screen to reduce the likelihood of damage to the screen.

It will be noted that due to the presence of the resilient pad 42 mounting the beam 36 to the frame members 22, at least some limited measure of flexibility exists allowing the cross beam to rock relative to members 22. Thereby, each beam and its tappet assembly 50 can readily adjust automatically to the crown which may exist on the screen as shown in FIG. 3 to eliminate the need for extensive adjustments when the screen is being tensioned or becomes stretched during use. Such ability to rock also results in uniform balancing of the load on the screen and uniform preloading of the screen.

To complete the vibrating structure of the preferred embodiment of the present invention, a suitable vibrator motor 54 is mounted preferably directly to the underside to each of the beams 36. The vibrator motor may either be powered electrically or hydraulically and is well within the selection of one skilled in the art. Suitable vibrator motors of either electric or hydraulic nature are available from TECK-0-MOTIVE, LaMoile, Ill., as their "Rhino" vibrators.

The screen 31 may take any one of a number of forms. It may comprise either screen cloth of woven mesh construction as might be typically used in solids classification or may take the form of tensioned wires as shown in U.S. Pat. No. 4,133,751. Although the screen 31 may consist of one long panel extending from the input to the discharge end of the screening deck, the screen preferably consists of two or more portions 56 and 56' as shown in FIGS. 2 and 3. The provision of more than one screen section enables more accurate tensioning of the several sections, better control of frequency and amplitude of the vibration of the several sections as will be described later, and also allows the screens to be alternated or rotated during use to obtain the maximum life of the screens during operation.

With particular reference to FIGS. 2, 3 and 6, where the two sections of screen 56 and 56' are utilized, the inner edges of each of the screen sections are preferably terminated by an elongate hooked flange 58 as best shown in FIG. 6. These flanges 58 are preferably hooked under the horizontal legs of elongate angles 60 which also extend transversely across the frame 20. The downwardly depending legs of angles 60, in turn, are bolted to a cross beam 62 by bolts 64 and the cross beam 62 terminates in end flanges 66 which are slotted at 68. Bolts 70 extend through the slots 68 and bolt the flanges 66 to the frame side members 22. This last mentioned construction, thereby, forms a screen anchor assembly, generally 72, which extends between ones of the tappet assemblies 50 to anchor the inner edges of the screens 56 and 56'. The slots 68 allow vertical adjustment of the anchor assembly 72 and rapid adjustment of the crown of the screens 56 and 56'.

The crowns of the screens 56 and 56' preferably extend transversely of the frame 20 and, thereby, prevent buildup of the solids adjacent the frame side members 22 such as frequently occurs in prior screening decks in which the screen is crowned longitudinally, rather than transversely. The screen crown of the sections 56 and 56' is further defined by somewhat arcuate side angle beams 74 as shown in FIG. 2 upon which the outer edges of the screen sections 56 and 56' rest. Side angle beams 74 may be attached to the frame side members 22 by suitable means, such as welding.

The opposite outer transverse edges of screen portions 56 and 56' also preferably include a hooked flange 76 similar to flanges 58 as previously described. Hooked flanges 76 are hooked into corresponding elongate hooks on a tension adjusting plate 78 which, in turn, is bolted to a plurality of downwardly extending angle members 80. The downwardly extending leg of each of the angle members 80 extends in parallel relationship to a transversely extending continuous angle member 82, the latter of which is fixed to the surface of transverse members 24, as shown in FIGS. 2 and 3, by suitable means, such as welding. A bolt 84 is threadedly tapped through the downwardly extending leg of each of the angle members 80 and the tip of the bolt bears against the downwardly extending leg of the transversely extending angle member 82. Thus, the tension on each of the screens 56 and 56' may be adjusted by threading the bolt 84 into or out to move tension adjusting plate 78 back and forth relative to angle member 82.

With particular reference to FIG. 7, a second embodiment of tappet assembly 50' is shown. In this embodiment, an additional bar 48' and resilient bead 52' have been added to the tappet assembly 50 previously described substantially intermediate the bars 48 and in slightly raised position relative to those bars. This additional bar 48' may be of advantage in additionally supporting the screen crown, particularly where the outer bars 48 are spaced a substantial distance apart and/or where the screen 31 must support unusually heavy loads of solids.

One of the important features of the present invention is the discovery that if the frequency and/or amplitude of the screen vibration is varied over the length of the screen during the screening operation, that a substantial efficiency increase is realized and the power or energy consumption of the operation may be further reduced. Preferably, a reduction in at least amplitude at the discharge end of the deck has been found to be quite advantageous in improving the quality and speed of the classification. To this end, each of the vibrator motors 54 is preferably separately controlled so that each of the tappet assemblies 50 may be fine tuned to the desired frequency and/or amplitude at its particular location on the deck.

The vibration control circuits for the motors 54 have not been shown because they are within the selection of one skilled in the art from among a wide range of speed controls which have been employed for other purposes. By way of example, a suitable speed control, where the motor 54 is electric, is available from Allen Bradley as its Bulletin 1330 speed control. This aforementioned speed control may vary the 60-cycle current to the motor to up to 1½ that number of cycles. Where the vibrator motor is hydraulic, a suitable speed control is available from MTE Hydraulics, Rockford, Ill., as its Delta-Flow divider.

To the inventors' knowledge, none of the prior art classifying apparatus or methods have incorporated such variable speed control on individual vibrator motors of a classifier. Indeed, in that prior art in which the entire frame is vibrated, it cannot be seen how the frequency or amplitude of the vibrations over the screen length could be varied because the entire screen and its frame must be vibrated and is usually vibrated by only a single vibrator motor. Even where only the screen is vibrated in the prior art, and even where it is vibrated by more than one vibrator motor, such apparatus and methods have essentially relied upon the 60-cycle power which is supplied to the vibrator motor which results in a uniform frequency of approximately 3600 vibrations per minute and in uniform amplitude for all of the vibrator motors, no matter where they are positioned on the screen.

It has also been discovered in the present invention that it is advantageous to increase the frequency of vibration where the solids which are being separated are finer. Thus, depending upon the nature of the solids to be separated, the frequency of vibration may vary anywhere between 1000 vpm to 7000 or more vpm. These frequency changes may be readily accomplished by the classifier incorporating the principles of the present invention because each of the vibrator motors of a given classifier may be individually finely tuned to tailor their performance to the nature of the solids being separated.

As a result of the classifying apparatus and methods of the invention heretofore described, the energy requirements in a typical classifying operation can be reduced substantially. For example, in the prior art apparatus and methods in which the entire frame of the screening deck is also vibrated, a motor of 40 horsepower or more is frequently required. However, when practicing the principles of the present invention, the size of the vibrator motors may be substantially reduced to as little as 4–6 motors of only ½ to 1½ horsepower each.

It has also been discovered that when practicing the principles of the present invention, blinding of the screen may be substantially reduced and the carryover of solids as overs which should otherwise be unders has been substantially reduced. For example, the classifying apparatus and method incorporating the principles of the present invention is readily capable of screening limestones of −20 mesh at a rate of 35–50 tons per hour, even where the moisture content of the limestone is 10% or more.

In the apparatus of the present invention, the plural tappet bars 48 and the resilient mounting pad 42 result in a self-centering tappet assembly and uniformity of tension on the screen 31, thereby substantially improving the efficiency of the classification, reducing the possibility of screen wear and maintenance, reducing the need for operational adjustments, reducing crown and tension changes in the screen, and result in uniformly balanced screen loadings and uniform pre-loading. Moreover, direct vibration of the screen by the tappet assemblies of the present invention eliminates substantial linkages which might otherwise be necessary which, in turn, reduces the weight of the assembly and the maintenance necessary. Also, because the tappet assemblies of the present invention are self-centering, it is not necessary to rely solely upon the weight of the material on the screen to maintain screen contact with the tappets.

By way of example, agricultural lime was screened using a vibrating screen deck constructed in accordance with the principles of the present invention in which the screen 56 was directly vibrated and in which the frequency and amplitude of the vibrations were varied between the upper and lower end of the screen. At the upper introduction end of the screen, the vibration was 4700 vpm, at the intermediate portion of the screen the vibration was 3600 vpm, and at the lower discharge end, the vibration was 2400 vpm. The same agricultural lime feeds were also screened using a conventional, frame vibrated deck at 1400 vpm and of substantially the same length as the deck of the present invention. The screen deck of the invention had a 3/32″×1½″ longslot screen cloth and averaged 160 tons per hour of unders. The conventional screen deck had a ⅛″×1½″ longslot screen cloth which would normally be expected to produce a greater amount of unders because of its larger mesh size. However, the conventional deck yielded 50–60% fewer unders where the total amount of materials processed by each screen was approximately 350 tons per hour.

Both coal and ash was also separated using the same decks as noted above, but using a different screen cloth on the deck of the present invention. A 1/16″×2″ longslot screen was used on the deck of the present invention. The same ⅛″×1½″ longslot screen cloth was used on the conventional deck. The vibration rates were substantially identical to those previously described. Again it would have been expected that the amount of unders would have been significantly greater using the conventional deck with the substantially larger mesh size screen cloth. However, the deck of the present invention produced 3.88 tons per hour of unders, whereas the conventional deck produced only 2.85 tons per hour of unders where the total amount of materials processed by each screen was approximately 320 tons per hour.

It has been discovered that when the conventional deck is operated at the same frequency and amplitude over its length, material which should otherwise be discharged as unders tends to become airborne and is discharged with the overs at the lower end of the screen. However, by decreasing the amplitude and frequency of vibration along the length of the screen and at the lower end of the screen where the materials are discharged, such tendency to become airborne is substantially reduced along with the attendant carryover of these materials which should otherwise be unders.

In operations such as chip cleaning in certain limestone and gravel separations, where there are only small amounts of unders in the material to be screened, low frequencies and amplitudes adjacent the lower end of the screen are desirable to reduce wear and power requirements and yet obtain a quality product. Conversely, where the unders constitute a major portion of the material being processed, such as in agricultural lime processing, high frequencies and amplitudes are desirable to fluidize the bed of material being screened at least at the upper end of the screen and prevent near size particles, i.e. particles of approximately the same size as the screen mesh, from plugging the screen cloth. Thus, it has been discovered that such frequencies may range anywhere between 1000–7000 vpm, depending on the nature of the materials being processed, including the moisture content, etc.

The amplitude may increase or decrease as the frequency is increased depending upon the loading on the screen and nature of the materials being processed as well as other factors. The amplitude is difficult to quantitatively measure. However, it can be stated that varying the frequency of vibration between the aforementioned range of 1000–7000 vpm will automatically result in a variation in the amplitude of vibration in a given deck. In practice, the operator of the deck will adjust the frequency of vibration of the deck for the given materials to be processed and when so adjusting the frequency, which is a measurable quantity, the amplitude will also be set so that separation performance is optimized. An important feature of the present invention is that both of these variables of amplitude and frequency may be varied over the length of the screen, whereas such variation was not contemplated in a given screening deck in the prior art.

It will be understood that the embodiments of the present invention which have been described are merely illustrative of a few of the applications of the principles of the invention. Numerous modifications may be made by those skilled in the art without departing from the true spirit and scope of the invention.

What is claimed is:

1. Classifying apparatus comprising:

frame means including a pair of spaced elongate rigid members, screen means supported in said frame means between said members, beam means supported between said members and extending beneath said screen means, tappet means fixed to said beam means and in continuous contact with said screen means at locations spaced from each other and from the ends of said screen means and vibratable independently of said frame means, and vibrator means mounted on said beam means between said members and directly vibrating said beam means, tappet means and screen means.

2. The classifying apparatus of claim 1, wherein said tappet means include at least a pair of elongate bar means fixed to said beam means and spaced from each other in a direction parallel to the members of said frame means, said elongate bar means extending in substantially parallel relationship to each other in contact with said screen means and substantially continuously between the members of said frame means.

3. The classifying apparatus of claim 1, including mounting means mounting said beam means to said frame means between said elongate members, said mounting means isolating the vibrations of said beam means from said frame means.

4. The classifying apparatus of claim 3, wherein said mounting means comprises resilient means mounted between said elongate members and the ends of said beam means.

5. The classifying apparatus of claim 1, including a plurality of said beam means, tappet means and vibrator means spaced along the length of said frame means.

6. The classifying apparatus of claim 5, including screen anchor means between said beam means, and said screen means includes a plurality of screen sections, each said screen section being vibrated independently of the other screen sections by respective ones of said plurality of beam means.

7. The classifying apparatus of claim 5, including control means for independently operating respective ones of said plurality of vibrator means to independently vary at least one of the frequency and amplitude of said vibrator means.

8. The classifying apparatus of claim 1, wherein said tappet means bear against said screen means to cause said screen means to crown in a direction parallel to said beam means.

9. The classifying apparatus of claim 8 including screen anchor means which is mounted for adjustment in a direction perpendicular to said beam means and said frame members.

10. The classifying apparatus of claim 1, including resilient mounting means mounting said beam means to said frame means between said elongate members, said mounting means isolating the vibrations of said beam means from said frame means, a plurality of said beam means, tappet means and vibrator means spaced along the length of said frame means, screen anchor means between said beam means, said screen means including a plurality of screen sections, each said screen section being vibrated independently of the other screen sections by respective ones of said plurality of beam means, said tappet means bearing against said screen means to cause said screen means to crown in a direction parallel to said beam means, and said tappet means includes at least a pair of elongate bar means fixed to said beam means and spaced from each other in a direction parallel to the members of said frame means, said elongate bar means extending in substantially parallel relationship to each other in contact with said screen means and substantially continuously between the members of said frame means.

11. The classifying apparatus of claim 10, including control means for independently operating respective ones of said plurality of vibrator means to independently vary at least one of the frequency and amplitude of said vibrator means.

12. Classifying apparatus comprising:

frame means including a pair of spaced elongate rigid members, screen means supported in said frame means between said members, a plurality of vibration inducing means supported between said members and continuously contacting said screen means to support said screen means and spaced along the length of said screen means at locations spaced from each other and from the ends of said screen means for vibrating said screen means at said locations independently of said frame means, and control means for independently operating respective ones of said vibration inducing means to vary at least one of the frequency and amplitude of the vibrations of said screen means at said locations over its length.

13. The classifying apparatus of claim 12, including isolation means for isolating the vibrations of at least some of said vibration inducing means from said frame means.

14. The classifying apparatus of claim 13 wherein said isolation means comprises resilient means between said vibration inducing means and said frame means.

15. A method of classifying solids from each other comprising the steps of:

mounting screen means on an incline on a deck including a frame, introducing the solids to be classified to the inclined screen means adjacent an inlet end thereof, continuously contacting said screen means to support said screen means by a plurality of vibration inducing means, vibrating said screen means by said vibration inducing means independently of the deck at at least two locations spaced from the inlet and discharge ends of the screen means, and varying at least one of the frequency and amplitude of the vibrations of said screen means at at least one of said locations relative to the other location.

16. The method of claim 15, wherein the frequency is varied between approximately 1000–7000 vpm.

17. The method of claim 15, wherein both the frequency and amplitude are less toward the discharge end of said screen means than toward the inlet end.

18. The method of claim 17, wherein the frequency is varied between approximately 1000–7000 vpm.

19. The method of claim 15, wherein at least the amplitude is less toward the discharge end of said screen means than toward the inlet end.

20. The method of claim 19, wherein the frequency is between approximately 1000–7000 vpm.

* * * * *